US011359388B2

(12) United States Patent
Elliott et al.

(10) Patent No.: US 11,359,388 B2
(45) Date of Patent: Jun. 14, 2022

(54) ADJUSTABLE MOLDING ASSEMBLIES AND METHODS

(71) Applicant: Aladdin Manufacturing Corporation, Calhoun, GA (US)

(72) Inventors: Benjamin R. Elliott, Ringgold, GA (US); David W. Moore, Acworth, GA (US)

(73) Assignee: Aladdin Manufacturing Corporation, Calhoun, GA (US)

( * ) Notice: Subject to any disclaimer, the term of this patent is extended or adjusted under 35 U.S.C. 154(b) by 0 days.

(21) Appl. No.: 17/037,016

(22) Filed: Sep. 29, 2020

(65) Prior Publication Data

US 2021/0095480 A1 Apr. 1, 2021

Related U.S. Application Data

(60) Provisional application No. 62/907,928, filed on Sep. 30, 2019.

(51) Int. Cl.
*E04F 19/06* (2006.01)
*E04F 19/04* (2006.01)

(52) U.S. Cl.
CPC ..... *E04F 19/0463* (2013.01); *E04F 19/0436* (2013.01); *E04F 19/065* (2013.01)

(58) Field of Classification Search
CPC ..... E04F 19/0459; E04F 19/0463; E04F 19/0468; E04F 19/06; E04F 19/065; E04F 19/066; E04F 19/061; E04F 19/062; E04F 19/063; E04F 19/064; E04F 19/0436
USPC ..... 52/459–468
See application file for complete search history.

(56) References Cited

U.S. PATENT DOCUMENTS 3,667,177 A * 6/1972 Biela ..... E04F 19/063 52/278
4,385,850 A * 5/1983 Bobath ..... F16B 5/0068 403/205
5,155,952 A * 10/1992 Herwegh ..... E04B 1/6803 52/100
6,230,385 B1 * 5/2001 Nelson ..... E04F 19/062 29/450
6,345,480 B1 * 2/2002 Kemper ..... E04F 19/063 52/395
6,588,165 B1 * 7/2003 Wright ..... E04F 19/06 52/459
8,646,237 B1 * 2/2014 Takagi ..... E04B 1/7629 52/464
2001/0005539 A1 * 6/2001 Neuhofer, Jr. ..... E04F 19/062 428/122

(Continued)

*Primary Examiner* — William V Gilbert
(74) *Attorney, Agent, or Firm* — Jenkins, Wilson, Taylor & Hunt, P.A.

(57) ABSTRACT

Adjustable molding assemblies and methods for bridging a gap between building elements are provided. The molding assembly includes a molding that includes a cover portion with opposing ends that are configured to contact outer surfaces of adjacent building elements. At least one flexible attachment portion extends from a lower surface of the cover portion, the at least one attachment portion including one or more interlocking elements. A track includes one or more grooves for receiving the attachment portion. One or more complementary interlocking elements are associated with each groove for retaining the attachment portion.

16 Claims, 6 Drawing Sheets

(56) References Cited

U.S. PATENT DOCUMENTS

| | | | | |
|---|---|---|---|---|
| 2008/0034696 | A1* | 2/2008 | Neuhofer | E04F 19/061<br>52/466 |
| 2010/0218448 | A1* | 9/2010 | Schacht | E04F 19/065<br>52/464 |
| 2014/0053490 | A1* | 2/2014 | Kessler | E04F 19/067<br>52/464 |

* cited by examiner

ADJUSTABLE MOLDING ASSEMBLIES AND METHODS

CROSS-REFERENCE TO RELATED APPLICATION

This application claims priority under 35 U.S.C. 119(e) to U.S. provisional application U.S. 62/907,928 filed on Sep. 30, 2019.

TECHNICAL FIELD

The subject matter herein relates generally to molding assembly and floor installation, and more particularly to adjustable molding assemblies and methods.

BACKGROUND

The presently disclosed subject matter is directed to molding assemblies for the finishing of floor covering materials or other interior panel materials, such as for example luxury vinyl tile (LVT) flooring, floating panel floorings, skirting boards, wall coverings, and ceiling panels. When installing these and other types of building materials, there is often a gap between adjacent elements. These gaps may be necessary for expansion, or they may be the result of transitions, such as between different types of flooring, for example, and they are typically filled or covered after the flooring is installed. This can be accomplished by a transition element such as a molded cover assembly.

The present disclosure solves the need for molding assemblies that allow for a universal finishing of transitions and gaps. The disclosed moldings, assemblies and flooring installations are configured to cover gaps between floorings and finish flooring edges across various heights and differences in elevation in a simple and cost-effective manner, while still maintaining a robust connection. The assembly can optionally be accomplished without the use of tools.

Accordingly, it is an object of the presently disclosed subject matter to provide apparatuses and methods for flooring installations. This and other objects are achieved in whole or in part by the presently disclosed subject matter.

An object of the presently disclosed subject matter having been stated above, other objects and advantages of the presently disclosed subject matter will become apparent to those of ordinary skill in the art after a study of the following description of the presently disclosed subject matter and non-limiting figures.

DETAILED DESCRIPTION

Figure 1:
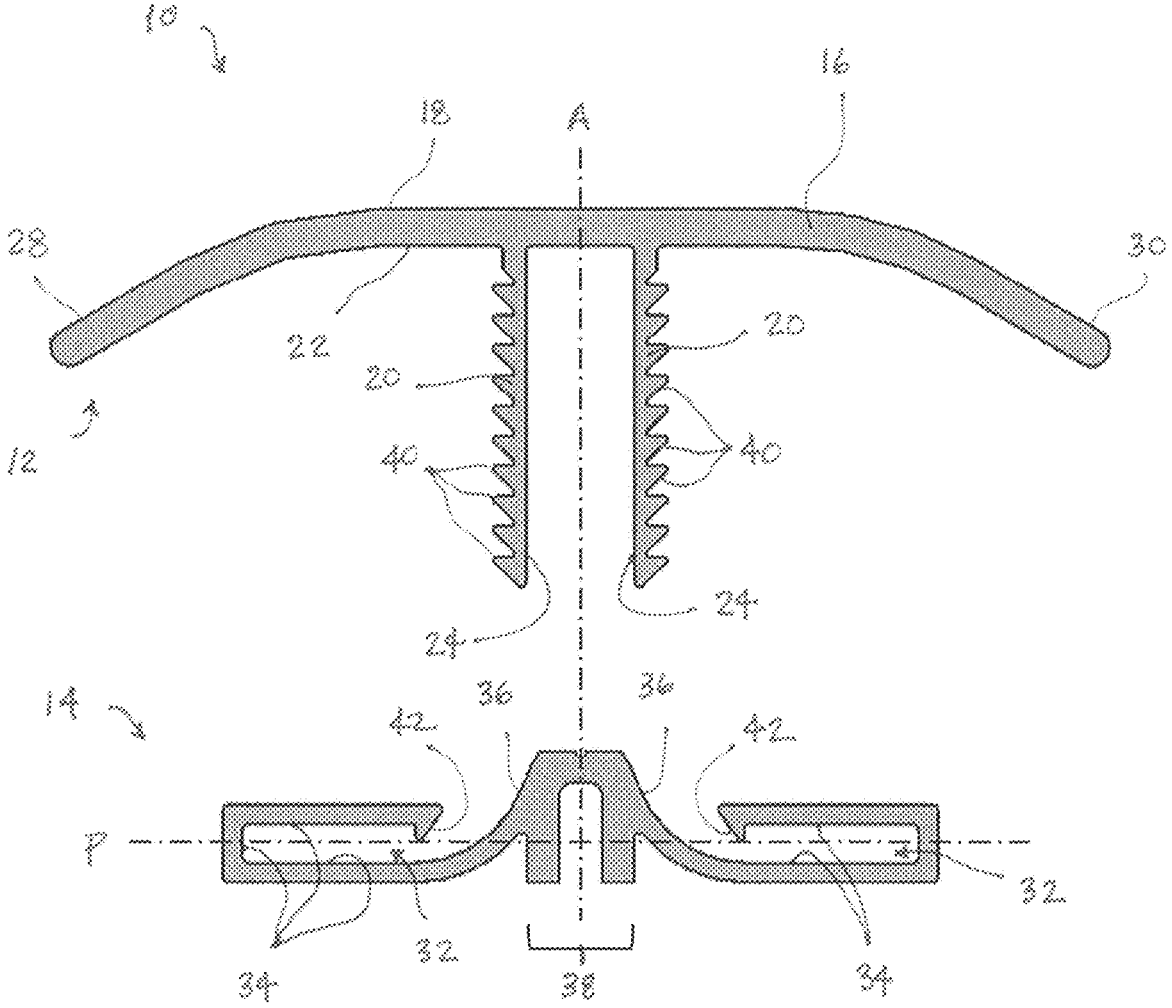
FIG. 1 of the drawings is a cross-sectional profile or view of an example embodiment of a molding assembly.

The presently disclosed subject matter will now be described more fully hereinafter with reference to the accompanying figures, in which representative embodiments are shown. The presently disclosed subject matter can, however, be embodied in different forms and should not be construed as limited to the embodiments set forth herein. Rather, these embodiments are provided so that this disclosure will be thorough and complete and will fully convey the scope of the embodiments to those skilled in the art. Some components in the figures may not necessarily be to scale, emphasis instead being placed upon illustrating the principles of the presently disclosed subject matter (in some cases schematically).

Unless otherwise defined, all technical and scientific terms used herein have the same meaning as commonly understood by one of ordinary skill in the art to which this presently described subject matter belongs. While the following terms are believed to be well understood by one of ordinary skill in the art, the following definitions are set forth to facilitate explanation of the presently claimed subject matter.

Following long-standing patent law convention, the terms "a", "an", and "the" refer to "one or more" when used herein, including in the claims.

As used herein, the term "about", when referring to a value or an amount, for example, relative to another measure, is meant to encompass variations of in some embodiments ±20%, in some embodiments ±10%, in some embodiments ±5%, in some embodiments ±1%, and in some embodiments ±0.1% from the specified value or amount, as such variations are appropriate. The term "about" can be applied to all values set forth herein.

As used herein, the term "and/or" when used in the context of a listing of entities, refers to the entities being present singly or in combination. Thus, for example, the phrase "A, B, C, and/or D" includes A, B, C, and D individually, but also includes any and all combinations and sub-combinations of A, B, C, and D.

The term "comprising", which is synonymous with "including," "containing," or "characterized by" is inclusive or open-ended and does not exclude additional, unrecited elements or method steps. "Comprising" is a terra of art used in claim language which means that the named elements are present, but other elements can be added and still form a construct or method within the scope of the claim.

As used herein, the phrase "consisting of" excludes any element, step, or ingredient not specified in the claim. When the phrase "consists of" appears in a clause of the body of a claim, rather than immediately following the preamble, it limits only the element set forth in that clause; other elements are not excluded from the claim as a whole.

With respect to the terms "comprising" and "consisting of", where one of these terms is used herein, the presently disclosed and claimed subject matter can include the use of the other term.

A molding assembly is disclosed for bridging a gap between adjacent interior panel building elements. In some embodiments, a molding assembly for bridging a gap between building elements as disclosed herein includes a molding and a track. The molding has a cover portion and at least one flexible attachment portion having that extends from a lower surface of the cover portion. The attachment portion has interlocking element. The track has a groove for receiving the attachment portion and a complementary interlocking element for retaining the attachment portion.

In some aspects, the attachment portion extends in a direction substantially perpendicular to the cover portion, and the groove of the track extends in a direction that is inclined or perpendicular to the attachment portion.

In some aspects, the molding and the track have two attachment portions and two grooves, respectively, where the grooves are disposed symmetrically about a central axis of the track.

In some aspects, the attachment portions have a plurality of interlocking elements disposed along the length such that the attachment portion can be locked in the groove at varying heights, and the attachment portions are lockable at different heights from one another.

In some aspects, a cross-sectional profile of the molding is T-shaped or has a curved shape. In some aspects, the track and/or the molding has an extruded profile. In some aspects, the building elements comprise flooring elements, skirting boards, wall coverings, and/or ceiling elements.

FIG. 1 illustrates a cross-sectional profile an embodiment of the disclosed molding assembly, generally designated 10. The assembly includes a molding 12 and a track 14. Molding 12 has a "bridge" or cover portion 16 having an upper surface 18 and at least one attachment portion 20, which protrudes from a lower surface 22 of cover portion 16. Attachment portion 20 includes retention elements 40 on one surface of attachment portion 14, while an opposite facing surface 24 is a smooth surface. Cover portion 16 also has opposing ends 28 and 30, which are configured to rest on an upper surface of the floor coverings or other building elements that are to be bridged. Track 14 can be mounted, for example, in the gap located between the building elements, which is to be covered. Track 14 can be attached at the preferred base level by any suitable method, such as mechanical fasteners, e.g., screws, or adhesives (not shown). The attachment portion 20 can then be inserted into a groove 32 of track 14, where it is captured by a track retention element 42, thus attaching molding 12 to track 14. Groove 32 is defined by an inner surfaces 34 of track 14.

Attachment portion 20 can be formed of a flexible or resilient material, which flexes to enter groove 32. In some embodiments, the assembly can be formed with only one attachment portion 20 and one groove 32. Attachment portion 20 is guided into groove 32 through an entry ramp 36 in track 14, which contacts the smooth surface 24 of attachment portion 20. Ramp 36 provides a smooth transition from the unflexed position of attachment portion 20 to the flexed position. Track 14 can be configured such that groove 32 is oriented in a direction that is perpendicular to the extended direction (i.e., the unflexed or unstressed direction) of attachment portion 20. Thus, attachment portion 20 flexes at an angle up to about 90° from the initial direction.

In the embodiment shown in FIG. 1, molding 12 has two attachment portions 20, and track 14 has two grooves 32. Attachment portions 20 and grooves 32 are spaced apart from one another on opposite sides of a central region 38 of track 14. Central region 38 is centered on an axis A of track 14. Axis A can be, but is not required to be, an axis of symmetry of molding assembly 10. Central region 38 can further provide stiffening or mounting features for track 14. Ramps 36 are also spaced apart from one another by a corresponding distance from axis A in order to facilitate entry of attachment portions 20 into grooves 32. In this example embodiment, ramps 36 guide attachment portions 20 in opposite directions from one another along a plane P defined by the centerline of grooves 32. Thus, in the locked position, the two attachment portions 20 are oriented at substantially 180° from one another. Other configurations are also possible.

Attachment portion 20 and groove 32 each comprise retention features to form a connection between these two elements. For example, in the embodiment shown in FIGS. 1-4, attachment portion 20 has "sawtooth" type ridges 40 inclined at an angle to the direction of insertion. Ridges 40 are repeated along the length of attachment portion 20 in order to provide multiple locking positions. Track 14 has a corresponding interlocking feature or retention element, tab 42, which engages with ridges 40. Tab 42 can be, for example, in the form of a barb or latch disposed at an entrance to groove 32. It is to be noted that ridges 40 and tab 42 are just one possible configuration of interlocking parts, and that the retention method can include any suitable type of barbs, ribs, ridges, vanes, threads, or any other structure or texture configured to provide a gripping or friction on a member.

Attachment portions 20 and grooves 32 may be continuous or discontinuous along the length of track 14, e.g., at regular or irregular intervals. The grooves 32 may be continuous while the attachment portions 20 are discontinuous, or the grooves 32 may be discontinuous while the attachment portions 20 are continuous. In some embodiments, the grooves 32 and/or the attachment portions 20 may be continuous and/or discontinuous. In some embodiments, one of the grooves 32 or attachment portions 20 is continuous while the other of the attachment portions 20 or grooves 32, respectively, is discontinuous.

Instead of a track 14 of considerable length, e.g., 0.8 meters or more, it may be advantageous for the track 14 to be in the form of several discrete track segments, e.g., with a length between 1.5 centimeters and 15 centimeters, arranged at least partially within and along the length of the gap G between the floor covering elements F1, F2 (see, e.g., FIG. 2), each track segment preferably having a cross-section similar as described above with relation to the track 14, e.g., with one or more or all of the groove or grooves 32, the ramp 36, and/or the interlocking feature or retention element, tab 42.

The assembly of track 14 and molding 12 may be made to allow for disassembly, for example by lifting up at least the tab 42 by means of a screw driver or other device and then sliding the attachment portion 20 out of the relevant groove 32, or by shifting and/or sliding the molding 12 lengthwise out of the track 14.

Figure 2:
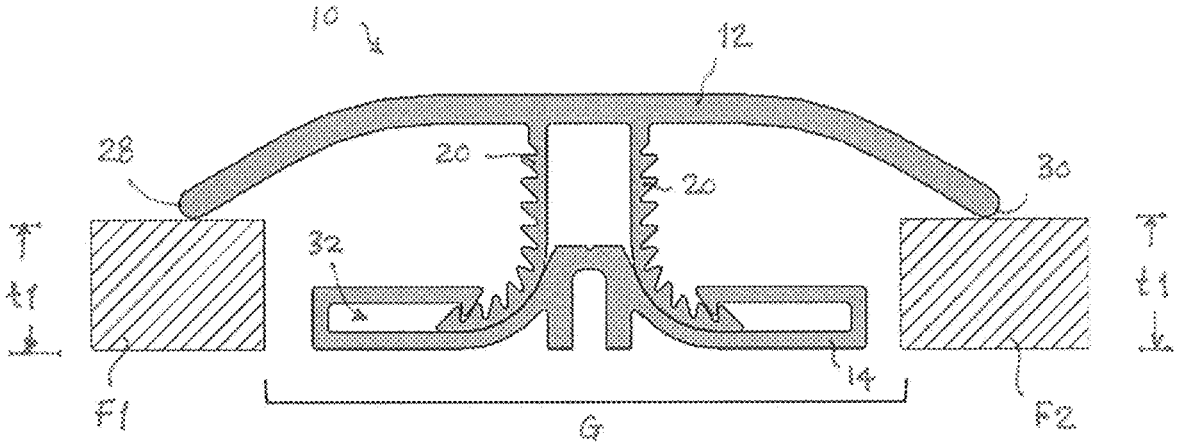
FIGS. 2, 3 and 4 of the drawings are cross-sectional profiles or views illustrating a molding assembly in various flooring installation configurations.
Figure 3:
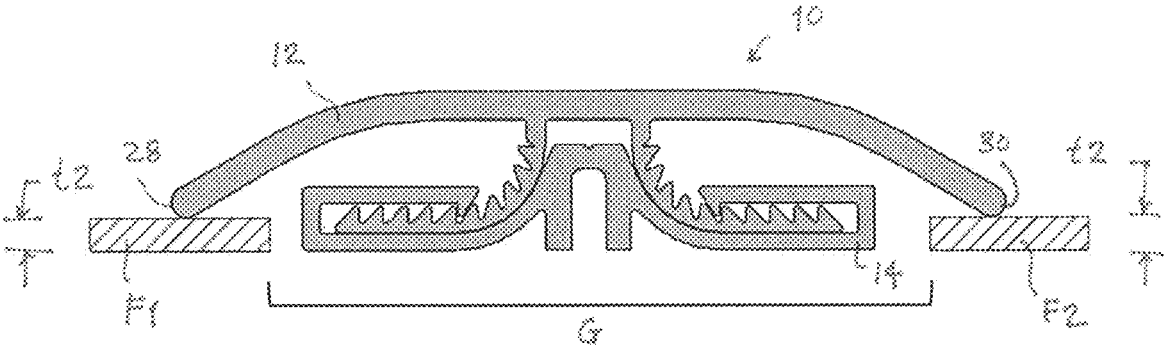
Figure 4:
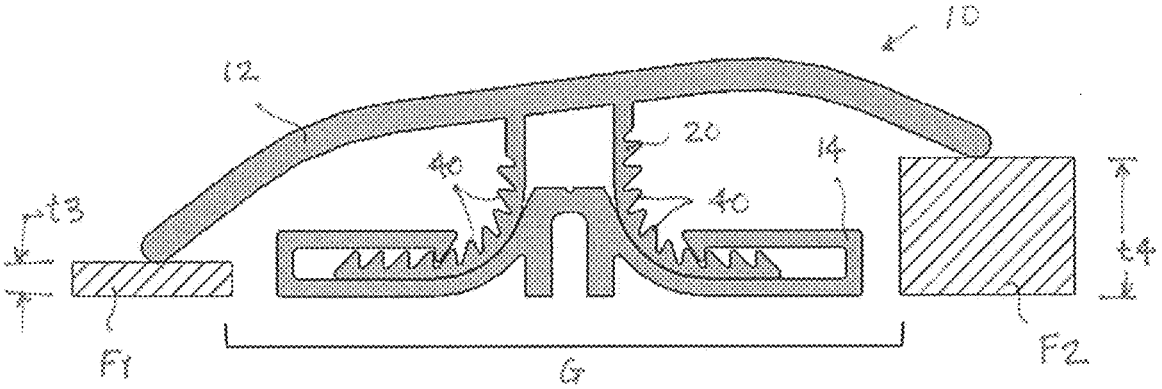

FIGS. 2, 3 and 4 of the drawings depict molding assembly 10 installed in various flooring installation configurations. Such flooring installations can comprise, for example, two or more adjoining floor covering elements F1 and F2, with a gap G between the elements. In some embodiments these flooring elements can be formed the same material, or they can be different flooring materials, e.g., at a transition zone, Track 14 can be mounted in the gap G at the same level as flooring elements F1 and F2 are mounted (e.g., mounted to the same subfloor). Other mounting heights, locations, and configurations for track 14 are also possible. Molding 12 can then be inserted into grooves 32 of track 14 until ends 28 and 30 of cover portion 16 come into contact with a top surface of flooring elements F1 and F2. The width of cover portion 16 is wide enough to cover the exposed edges of flooring elements F1 and F2.

FIGS. 2, 3 and 4 also illustrate the versatility of molding assembly 10. In FIG. 2, for example, molding assembly 10 bridges two relatively thick flooring elements F1 and F2, each having a thickness t1. FIG. 3, on the other hand, depicts molding assembly 100 bridging two relatively thin flooring elements, each having a thickness t2. Because attachment portion 20 has numerous ridges 40 spaced along the full extent of its length, molding 12 can be inserted into track 14 at many discrete intervals in order to accommodate a wide range of flooring heights. It is further conceivable that the interlocking features can be formed in such a way that allows a virtually continuous range of locking heights within a given overall range. In a non-limiting example, molding assembly 10 can be used with flooring elements that range in thicknesses from about 2 millimeters (mm) to 8 mm (0.078 inches-0.315 inches).

Molding assembly 10 is not limited to bridging building elements that have the same thickness. As depicted in FIG. 4, molding 12 can also bridge a gap G between two flooring elements F1 and F2 that have two different thicknesses t3 and t4. In the embodiment shown, each attachment portion 20 can be inserted into each groove 32 by differing amounts as needed to lock cover portion 16 onto the upper surfaces of F1 and F2. Ridges 40 can be locked different positions with each respective tab 42, resulting in a tilted orientation of cover portion 16. In this manner a reducing transition between floor coverings at different levels can be attained.

It can also be noted from FIG. 3 that, due to the high flexibility of attachment portion 20, the overall height of molding assembly 10 can be minimized while still operating with a wide range of flooring thicknesses. In the embodiment shown, track 14 occupies a space under molding 12 formed by a tapered profile of cover portion 16. Thus, the thickness of track 14 can be greater than a thickness of the flooring elements F1 and F2. At the same time, cover portion 16 can also be formed with a low profile, for example to reduce trip hazards or for aesthetic purposes.

The shape of cover portion 16 can be configured in any suitable fashion to cover the gap between the associated flooring elements. For example, the illustrated embodiment has a substantially "T" shaped profile with downwardly tapering ends. This type of profile is particularly suited for covering prescribed expansion gaps between flooring elements. The profile of cover portion 16 can also take any other suitable form, such as for example a completely flat profile, a curved profile that is convex, concave, parabolic, etc., or an asymmetric profile.

In some embodiments the profiles of molding 12 and track 14 can comprise an extruded or injection molded profile and can be made from any suitable material, including for example but not limited to, polyvinyl chloride (PVC), polypropylene (PP), polyethylene (PE), polyethylene terephthalate (PET), and/or combinations thereof. Preferably at least the molding comprises two or more zones of different material compositions, which are present in one and the same extruded profile, e.g. obtained by coextrusion of the different material compositions. Preferably, in this way, the attachment portions 20 are made more flexible than the upper surface of the molding 12. In some embodiments molding 12 and track 14 can comprise an aluminum or plastic material, or any suitable material for a flooring joint, transition profile, border, molding or finishing component.

Upper surface 18 of molding 12 can also be configured with various colors, finishes, textures, embossments, etc. to meet aesthetic or construction requirements. It is to be further noted that molding assembly 10 is not limited to use between flooring elements but can also be used in other applications where a transition between two adjoining elements is present, such as skirting boards, wall coverings, or ceilings.

Figure 5A:
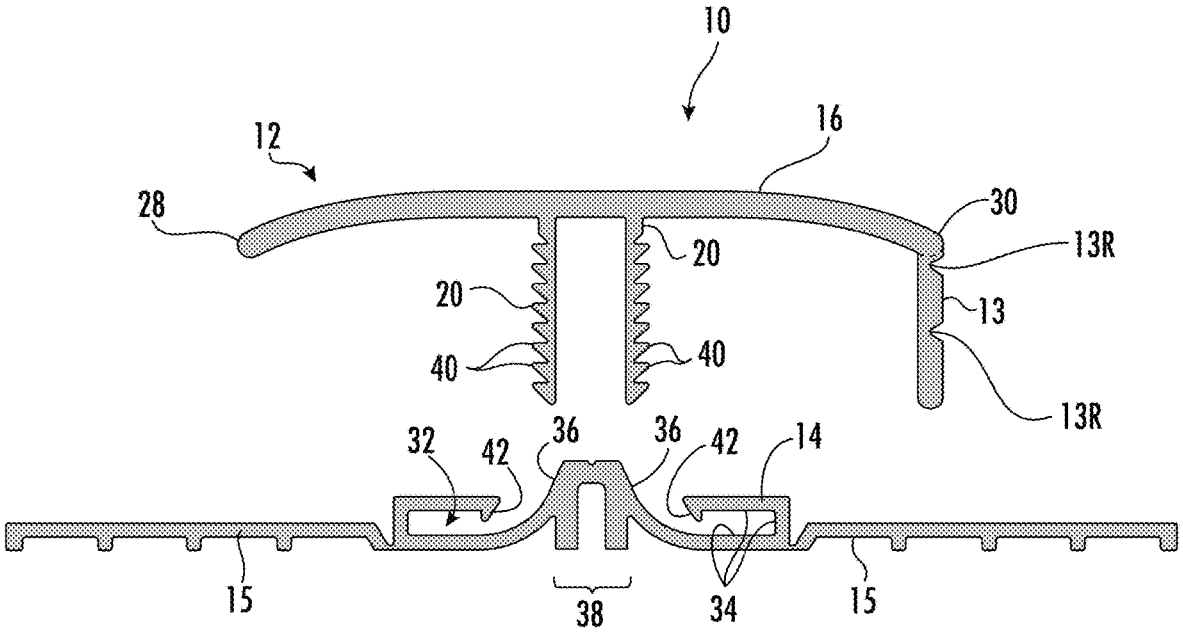
FIGS. 5A and 5B of the drawings are cross-sectional profiles or views illustrating an example embodiment of the molding assembly.
Figure 5B:
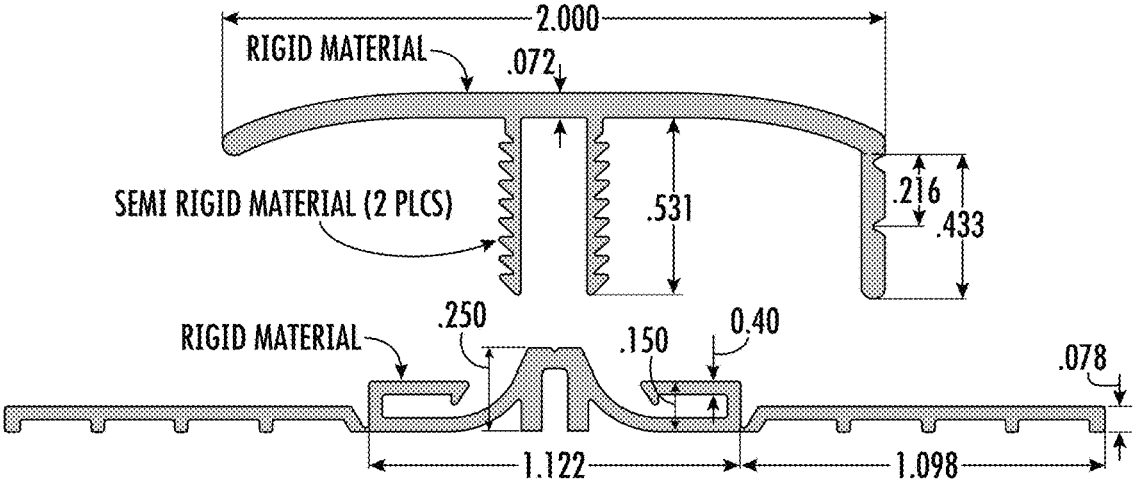

FIGS. 5A and 5B illustrate an example embodiment of the molding assembly 10 disclosed herein. According to this embodiment, the molding 12 has, at one of the ends 30 thereof, a segmented tab 13 connected thereto. The designation of the tab 13 being connected at the end 30 is arbitrary, such that it is contemplated that the tab 13 could instead be connected at the end 28 of the molding 12. In some further embodiments, such a tab 13 could be attached to the molding 12 at both ends 28, 30, the tabs being inclined at the same angle, or a different angle, as each other from the planar portion of the cover portion 16. In the embodiment shown, the tab 13 extends in a direction that is substantially perpendicular to the planar portion of cover portion 16. In some embodiments, the tab 13 extends at a non-perpendicular angle (e.g., an acute angle or an obtuse angle) from the planar portion of the cover portion 16. The tab 13 is provided, in some embodiments, so that the molding 12 can abut a vertically-oriented structure (e.g., a wall) at the end 28, 30 at which the tab 13 is attached to the molding 12. As used herein, a definition for abut can be, but is not necessarily limited exclusively to, the tab 13 and/or the end 28, 30 being against, adjacent to, in contact with, etc. some adjacent structure to provide an aesthetically pleasing transition therebetween. In some embodiments, the structure may be a wall, a step, an adjacent flooring type having a significantly increased height that is to be bridged and/or hidden by the cover portion 16, and the like. The tab 13 has one or more recesses 13R where the thickness of the tab 13 is reduced to aid in removing a portion or all of the tab 13 from the molding 12. It may be advantageous to remove all of the tab 13 when the molding 12 is not to be installed abutting a vertically extending surface of an adjacent structure. It may be advantageous to remove a portion of the tab 13 when it is desired for the angle of the planar portion of the cover portion 16 to be reduced. The recesses 13R also allow for the tab to pivot relative to the molding 12 to allow for misalignments between adjacent structures during installation of the molding assembly 10. During installation, the end 28 is pressed against an adjacent structure to be in contact therewith and the tab 13 is pressed against an adjacent structure. As a result, the end 30 at which the tab 13 is attached to the molding 12 is higher, when the molding assembly 10 is assembled, than the end 28 which is devoid of the tab 13, such that the planar portion of the cover portion 16 is inclined relative to any upper surfaces of the adjacent structures.

In the example embodiment shown in FIGS. 5A and 5B, the track 14 has, attached to one or both lateral edges thereof, platforms 15. These platforms 15 can be oriented in the manner shown to change a height of one or more of the adjacent structures defining the gap which is to be hidden by the molding assembly 10. In some embodiments, one or both of the platforms 15 can be removed from the track 14. In some embodiments, one or both of the platforms 15 can be rotated to be arranged underneath the bottom surface of the track 14 to increase the installed height of the track 14 by the thickness of one or both of the platforms 15. In some such embodiments, it may be advantageous to bend only one of the platforms 15 to be underneath the track 14 to increase the installed height of the track 14 by the thickness of only one platform 15, with the other platform 15 being either removed or positioned beneath an adjacent structure. Example dimensions and characteristics are shown in FIG. 5B for the embodiment of the molding assembly 10 shown in FIG. 5A. Elements that are substantially identical to, and numbered the same as, those structures and/or features described elsewhere herein are the same, the descriptions of which are incorporated herein.

Figure 6:
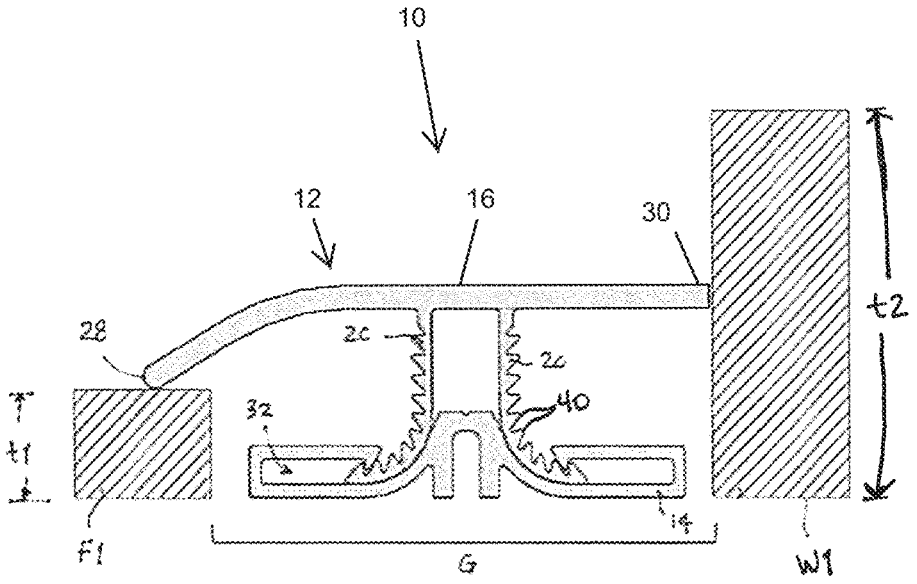
FIG. 6 of the drawings is a cross-sectional profile or view of another example embodiment of a molding assembly.
Figure 7:
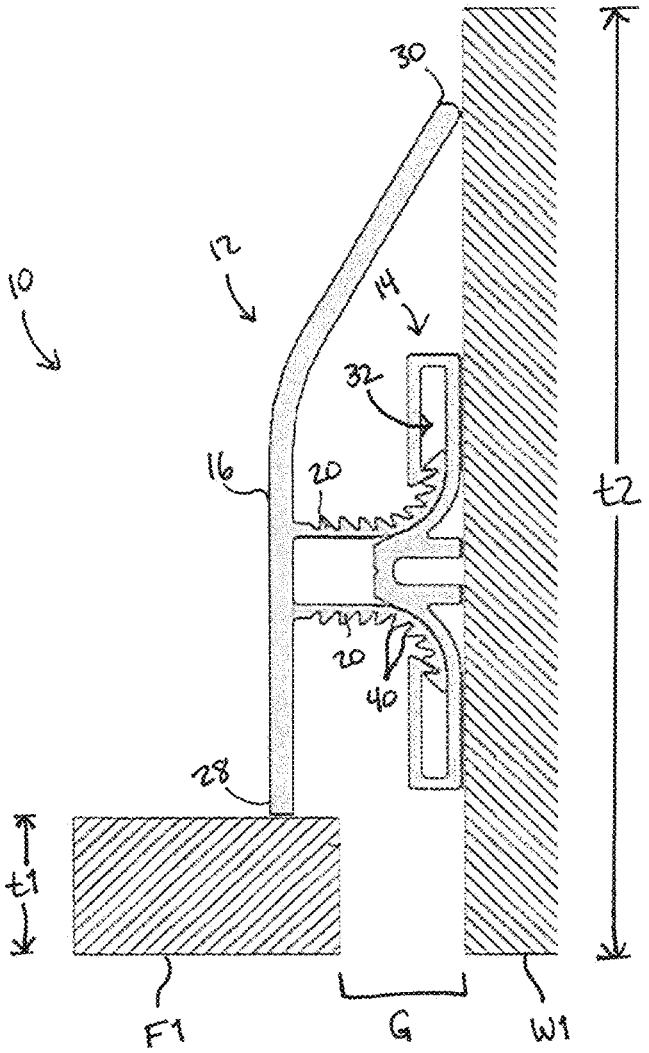
FIG. 7 of the drawings is a cross-sectional profile or view of another example embodiment of a molding assembly.

FIG. 6 shows another example embodiment of such a molding assembly 10 as described elsewhere herein. In the embodiment shown in FIG. 6, the molding 12 has an asymmetrical profile, with the end 30 being coplanar with the central planar portion of the cover portion 16, such that only one edge of the molding 12 has a curved profile at end 28. The end 30 is arranged to abut against a vertically-extending structure, such as a wall W1 having a height t2, with the end 28 being curved to provide a substantially imperceptible interface with a horizontally extending structure, such as a floor F1 having a height t1. The tab (13, see FIG. 5A) of the embodiment shown in FIGS. 5A and 5B may be included on end 30 in some embodiments. As such, the molding assembly 10 in FIG. 6 is, when installed in the position shown in FIG. 6, capable of hiding (e.g., visually occluding) the gap G present between wall W1 and floor F1. Elements that are substantially identical to, and numbered the same as, those structures and/or features described elsewhere herein are the same, the descriptions of which are incorporated herein.

FIG. 1 shows still another example embodiment of such a molding assembly 10 as described elsewhere herein. According to this embodiment, the molding assembly 10 is configured as a skirting board, wherein the molding assembly 10 is attached, via the track 14, to the vertically-extending surface of a wall, for example, wall W1. The installation of the molding 12 to the track 14 is substantially similar to that described hereinabove in other embodiments, but the molding assembly 10 is, when installed as a skirting board, able to provide an aesthetically pleasing transition between a floor F1 and a wall W1 where a gap G is typically present (e.g., to allow for the lateral expansion and contraction of the materials of the floor F1 during typical use). In this embodiment, the end 30 is inclined relative to the planar portion of the cover portion 16 and abuts the wall W1, while the end 28 is substantially parallel to the direction of extension of the wall W1 and abuts against the floor F1. Elements that are substantially identical to, and numbered the same as, those structures and/or features described elsewhere herein are the same, the descriptions of which are incorporated herein.

Figure 8:
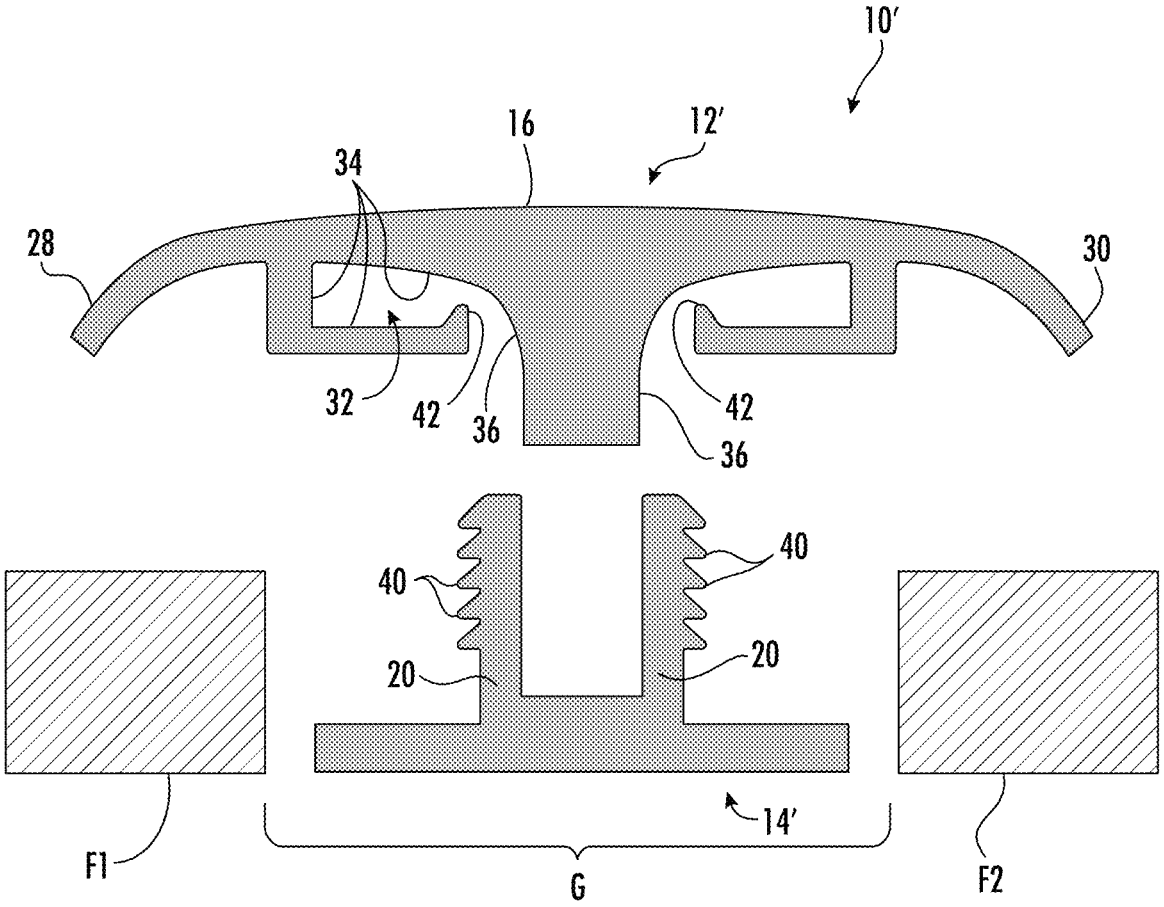
FIG. 8 of the drawings is a cross-sectional profile or view of another example embodiment of a molding assembly.

In FIG. 8, a further example embodiment of a molding assembly 10' is shown. According to this embodiment, the attachment features shown on the respective molding 12 and track 14 are reversed, such that the track 14' has the attachment portion(s) 20, on which the retention elements 40 are formed, with the molding 12' having the groove(s) 32 into each of which one of the attachment portions is inserted. The distal ends of the attachment portions 20 are guided into a corresponding one of the grooves 32 by the inclined surfaces of the ramp 36. At the entry point of each of the grooves 32 is a retention element 42 which lockingly engages with the retention elements 40 of the attachment portions 20, such that the attachment portions 20 cannot be removed from the grooves 32 once inserted therein. The retention elements 40 can be in the form of serrations, or teeth, with the retention elements 42 being in the form of hooks that interface with and have a complementary or interlocking profile of the teeth of the retention elements 40. Elements that are substantially identical to, and numbered the same as, those structures and/or features described elsewhere herein are the same, the descriptions of which are incorporated herein.

It will be understood that various details of the presently disclosed subject matter may be changed without departing from the scope of the presently disclosed subject matter. Furthermore, the foregoing description is for the purpose of illustration only, and not for the purpose of limitation.

The invention claimed is:

1. A molding assembly for bridging a gap between building elements, the molding assembly comprising:

a molding comprising:

a cover portion with opposing ends that are configured to contact outer surfaces of adjacent building elements; and at least two flexible attachment portions, each of which extends from a lower surface of the cover portion and comprises one or more interlocking elements; and a track comprising:

two grooves for receiving the attachment portions and guiding the attachment portions in opposite directions from one another, wherein the grooves each comprise an entry ramp and an interlocking element for retaining the attachment portion.

2. The molding assembly of claim 1, wherein the attachment portions extend in a direction substantially perpendicular to the cover portion, and wherein the grooves of the track extend in a direction that is inclined to the attachment portions.

3. The molding assembly of claim 1, wherein the attachment portions extend in a direction substantially perpendicular to the cover portion, and wherein the grooves of the track extend in a direction that is substantially perpendicular to the attachment portions.

4. The molding assembly of claim 1, wherein the grooves are disposed symmetrically about a central axis of the track.

5. The molding assembly of claim 1, comprising a plurality of interlocking elements disposed along a length of the attachment portions, such that the attachment portions can be locked at varying heights.

6. The molding assembly of claim 1, wherein a cross-sectional profile of the molding is T-shaped.

7. The molding assembly of claim 1, wherein a cross-sectional profile of the cover portion has a curved shape.

8. The molding assembly of claim 1, wherein the track and/or the molding comprises a profile suitable for forming via extrusion.

9. The molding assembly of claim 1, wherein the building elements comprise one or more of floors, skirting boards, walls, and/or ceilings.

10. The molding assembly of claim 1, wherein the molding comprises a segmented tab extending from an end of the cover portion, the segmented tab being configured to abut a substantially vertically-oriented or inclined surface of an adjacent one of the building elements.

11. The molding assembly of claim 10, wherein the segmented tab comprises one or more recesses configured for flexing the segmented tab and/or severing a portion of, or all of, the segmented tab from the cover portion.

12. The molding assembly of claim 10, wherein the segmented tab extends substantially parallel to a direction of extension of the flexible attachment portions.

13. The molding assembly of claim 10, wherein the segmented tab extends at a non-zero angle relative to a direction of extension of the flexible attachment portions.

14. A molding assembly for bridging a gap between building elements, the molding assembly comprising:

a molding comprising:

a cover portion with opposing ends that are configured to contact outer surfaces of adjacent building elements; and two flexible attachment portions that extend from a lower surface of the cover portion, the attachment portions comprising a plurality of interlocking elements on outward facing surfaces thereof; and a track comprising:

two grooves disposed symmetrically about a central region of the track for receiving the attachment portions and guiding the attachment portions in opposite directions from one another;

wherein the grooves each comprise an entry ramp and an interlocking element for retaining the attachment portions.

15. A molding assembly for bridging a gap between building elements, the molding assembly comprising:

a track comprising:

two flexible attachment portions, each of which comprises one or more interlocking elements; and a molding comprising:

a cover portion with opposing ends that are configured to contact outer surfaces of adjacent building elements; and two grooves that extend from a lower surface of the cover portion for receiving the attachment portions and guiding the attachment portions in opposite directions from one another, wherein the grooves each comprise an entry ramp and an interlocking element for retaining the attachment portions.

16. A method for covering a gap between adjacent building elements, the method comprising:

providing a molding assembly comprising:

a molding comprising:

a cover portion with opposing ends that are configured to contact outer surfaces of adjacent building elements; and two flexible attachment portions, each of which extends from a lower surface of the cover portion and comprises one or more interlocking elements; and a track comprising:

two grooves for receiving the attachment portions and guiding the attachment portions in opposite directions from one another, wherein the grooves each comprise an entry ramp and an interlocking element for retaining the attachment portions mounting the track in the gap between the adjacent building elements; and inserting the molding into the track until the cover portion rests against the outer surfaces of the building elements.

* * * * *